US011545778B2

(12) United States Patent
Lee

(10) Patent No.: US 11,545,778 B2
(45) **Date of Patent: *Jan. 3, 2023**

(54) INPUT/OUTPUT CONNECTOR AND ELECTRONIC DEVICE INCLUDING THE SAME

(71) Applicant: Samsung Electronics Co., Ltd., Gyeonggi-do (KR)

(72) Inventor: Sunmi Lee, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/494,928

(22) Filed: Oct. 6, 2021

(65) Prior Publication Data

US 2022/0029343 A1 Jan. 27, 2022

Related U.S. Application Data

(63) Continuation of application No. 16/910,217, filed on Jun. 24, 2020, now Pat. No. 11,146,013.

(30) Foreign Application Priority Data

Jun. 24, 2019 (KR) ..... 10-2019-0075283

(51) Int. Cl.
*H01R 13/447* (2006.01)
*H01R 24/64* (2011.01)
(Continued)

(52) U.S. Cl.
CPC ..... *H01R 13/447* (2013.01); *H01R 13/6272* (2013.01); *H01R 24/64* (2013.01); *H01R 13/6456* (2013.01)

(58) Field of Classification Search
CPC .. H01R 13/447; H01R 13/6272; H01R 24/64; H01R 13/645; H01R 13/4532
See application file for complete search history.

(56) References Cited

U.S. PATENT DOCUMENTS 6,135,802 A 10/2000 Nakamura
6,490,186 B2 12/2002 Cho
(Continued)

FOREIGN PATENT DOCUMENTS

DE 20 2004 008 816 U1 11/2004
KR 20-189657 Y1 7/2000
(Continued)

OTHER PUBLICATIONS

European Search Report dated Jun. 2, 2022.

*Primary Examiner* — Tho D Ta
(74) *Attorney, Agent, or Firm* — Cha & Reiter, LLC

(57) ABSTRACT

An electronic device and an input/output connector are disclosed. The device may include the input/output connector, which may include a housing including an opening, a cover that covers at least a portion of the opening, the cover connected to the housing by a hinge, and forming an external appearance of the electronic device together with the housing, an elastic body connected to the housing and the cover, and an insertion hole formed by the housing and the cover, into which a cable terminal is insertable for connection with an external device, wherein a size of the insertion hole is changeable according to the rotation of the cover.

20 Claims, 15 Drawing Sheets

(51) Int. Cl.
*H01R 13/627* (2006.01)
*H01R 13/645* (2006.01)

(56) References Cited

U.S. PATENT DOCUMENTS

| | | | | |
|---|---|---|---|---|
| 6,971,921 | B1 | 12/2005 | Lai | |
| 7,950,936 | B2 | 5/2011 | Wang et al. | |
| 8,840,416 | B2 | 9/2014 | Huang | |
| 8,936,475 | B2 | 1/2015 | Wang | |
| 8,986,023 | B2 * | 3/2015 | Lee | H01R 13/447 439/138 |
| 9,153,985 | B1 | 10/2015 | Gjovik et al. | |
| 9,531,106 | B2 * | 12/2016 | Tseng | H01R 13/453 |
| 11,146,013 | B2 * | 10/2021 | Lee | H01R 24/64 |
| 2010/0227486 | A1 | 9/2010 | Lin et al. | |
| 2010/0248554 | A1 | 9/2010 | Hung et al. | |
| 2013/0034985 | A1 | 2/2013 | Lin et al. | |
| 2013/0231010 | A1 | 9/2013 | Liang et al. | |
| 2013/0260581 | A1 * | 10/2013 | Kuo | H01R 13/627 439/138 |
| 2014/0106584 | A1 | 4/2014 | Huang | |
| 2014/0134858 | A1 | 5/2014 | Tseng et al. | |
| 2014/0134859 | A1 | 5/2014 | Lee et al. | |
| 2014/0177861 | A1 | 6/2014 | Yu | |
| 2015/0118874 | A1 | 4/2015 | Watanabe | |
| 2015/0140842 | A1 | 5/2015 | Ke et al. | |
| 2015/0364875 | A1 | 12/2015 | Ginsberg | |

FOREIGN PATENT DOCUMENTS

| | | | |
|---|---|---|---|
| KR | 10-2005-0051439 | A | 6/2005 |
| KR | 10-2012-0059249 | A | 6/2012 |
| KR | 10-2014-0081343 | A | 7/2014 |
| WO | 2014/073224 | A1 | 5/2014 |

* cited by examiner

INPUT/OUTPUT CONNECTOR AND ELECTRONIC DEVICE INCLUDING THE SAME

CROSS-REFERENCE TO RELATED APPLICATION(S)

This application is a Continuation of U.S. patent application Ser. No. 16/910,217, filed on Jun. 24, 2020 which is based on and claims priority under 35 U.S.C. § 119 to Korean Patent Application No. 10-2019-0075283, filed on Jun. 24, 2019, in the Korean Intellectual Property Office, the disclosure of which is incorporated by reference herein in its entirety.

BACKGROUND

Field

The disclosure relates generally to an electronic device, and more particularly, to an electronic device including an input/output connector.

Description of Related Art

An electronic device may include an input/output connector for connection with an external device. The electronic device may include one or more input/output connectors according to the design specification. There may be various types and shapes for input/output connectors (e.g., symmetrical or asymmetrical) depending on the external devices to be connected.

In a situation where various input/output connectors and various cable terminals are present, when a specific cable terminal is inserted in a wrong direction or otherwise misaligned into a corresponding input/output connector, the input/output connector may be damaged.

SUMMARY

Aspects of the disclosure are made to address at least the above-mentioned problems and/or disadvantages and to provide at least the advantages described below. Accordingly, an aspect of the disclosure is to provide an input/output connector that has a structure that prevents a cable terminal from being inserted in a wrong direction.

In accordance with an aspect of the disclosure, there is provided an input/output connector. The input/output connector may include: a housing including an opening, a cover that covers at least a portion of the opening, the cover connected to the housing by a hinge, and forming an external appearance of the electronic device together with the housing, an elastic body connected to the housing and the cover, and an insertion hole formed by the housing and the cover, into which a cable terminal is insertable for connection with an external device, wherein a size of the insertion hole is changeable according to the rotation of the cover.

In accordance with another aspect of the disclosure, there is provided an electronic device. The electronic device may include: a housing including an opening, a connection cable housed in an internal space of the housing that is extendable from and retractable into the housing, for connection with an external electronic device, and an input/output connector disposed in the opening of the housing, wherein the input/output connector comprises: a cover that covers at least a portion of the opening of the housing, is hinged to the housing, and constitutes an external appearance of the electronic device together with the housing, an elastic body connected to the housing and the cover, and an insertion hole formed by the housing and the cover, into which a cable terminal is insertable for connection with an external device, wherein a size of the insertion hole is changeable according to the rotation of the cover.

According to the disclosure, the input/output connector is provided with a structure that can block the insertion itself when an attempt is made to incorrectly insert a cable terminal into the input/output connector (e.g., insertion in reverse direction). Hence, the input/output connector can be prevented from being damaged.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
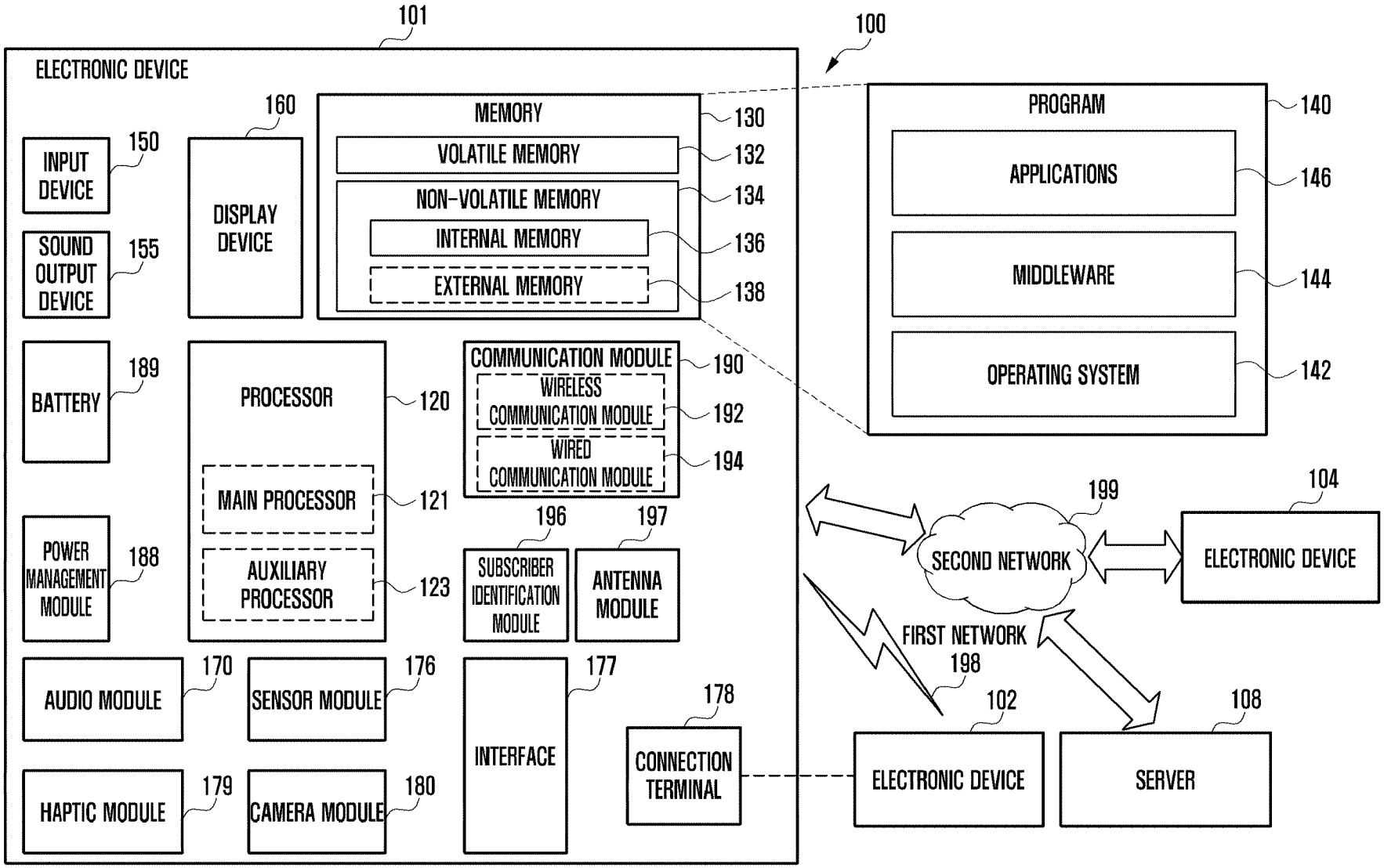
FIG. 1 is a block diagram of an electronic device in a network environment according to various embodiments.

Hereinafter, embodiments of the disclosure will be described in detail with reference to accompanying drawings. In the disclosure, embodiments are described in the drawings and a related detailed description is set forth, but this is not intended to limit the embodiments of the disclosure. Descriptions of well-known functions and constructions are omitted for the sake of clarity and conciseness.

FIG. 1 is a block diagram illustrating an electronic device 101 in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thererto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor(e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 2:
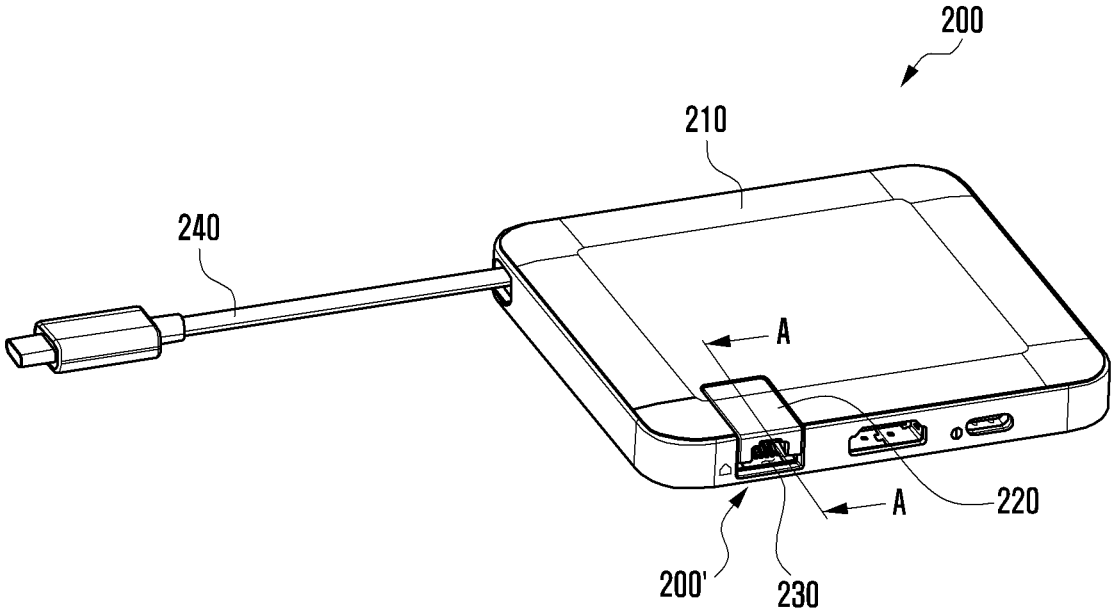
FIG. 2 is a view of an electronic device according to an embodiment of the disclosure.
Figure 3:
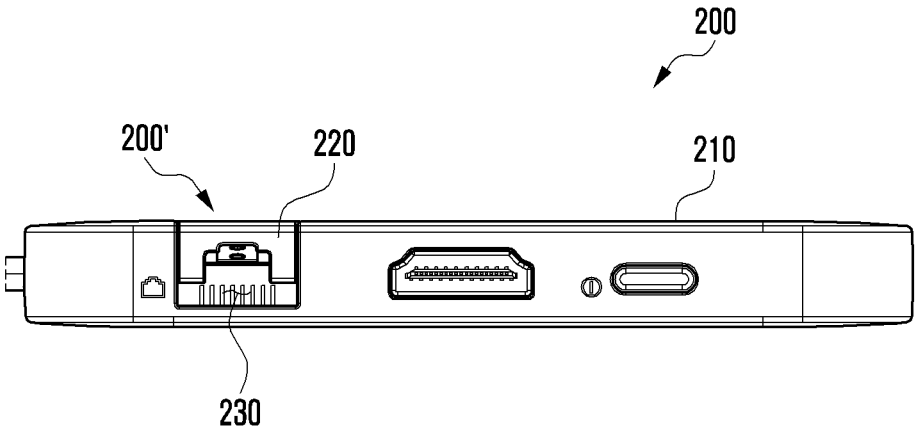
FIG. 3 is a view of an input/output connector in the electronic device according to an embodiment of the disclosure.

FIG. 2 is a view of an electronic device 200 according to an embodiment of the disclosure, and FIG. 3 is a front view of an input/output connector 200' in the electronic device 200 according to an embodiment of the disclosure.

With reference to FIGS. 2 and 3, the electronic device 200 according to an embodiment of the disclosure may include a housing 210, an input/output connector 200', and/or a connection cable 240. In one embodiment, the housing 210 may form the overall appearance of the electronic device 200, have an internal space, and house various electronic components. For example, a processor (e.g., processor 120 in FIG. 1), a memory (memory 130 in FIG. 1), or a communication module (e.g., communication module 190 in FIG. 1) may be embedded.

In one embodiment, the connection cable 240 is used to physically connect the electronic device 200 to an external electronic device (not shown), and may be used to exchange data with the external electronic device and/or to receive power.

In one embodiment, the input/output connector 200' (e.g., connection terminal 178 in FIG. 1) may indicate a connector through which the electronic device 200 may be physically connected to an external device (e.g., electronic device 102 in FIG. 1). An insertion hole 230 may be formed, allow insertion of the cable terminal 300 for physical connection. For example, the input/output connector 200' may include an HDMI connector, a USB connector, an SD card connector, or an audio connector (e.g., headphone connector). However, in one embodiment, a connector for LAN communication may be utilized as the input/output connector 200' according to an embodiment of the disclosure.

Figure 4:
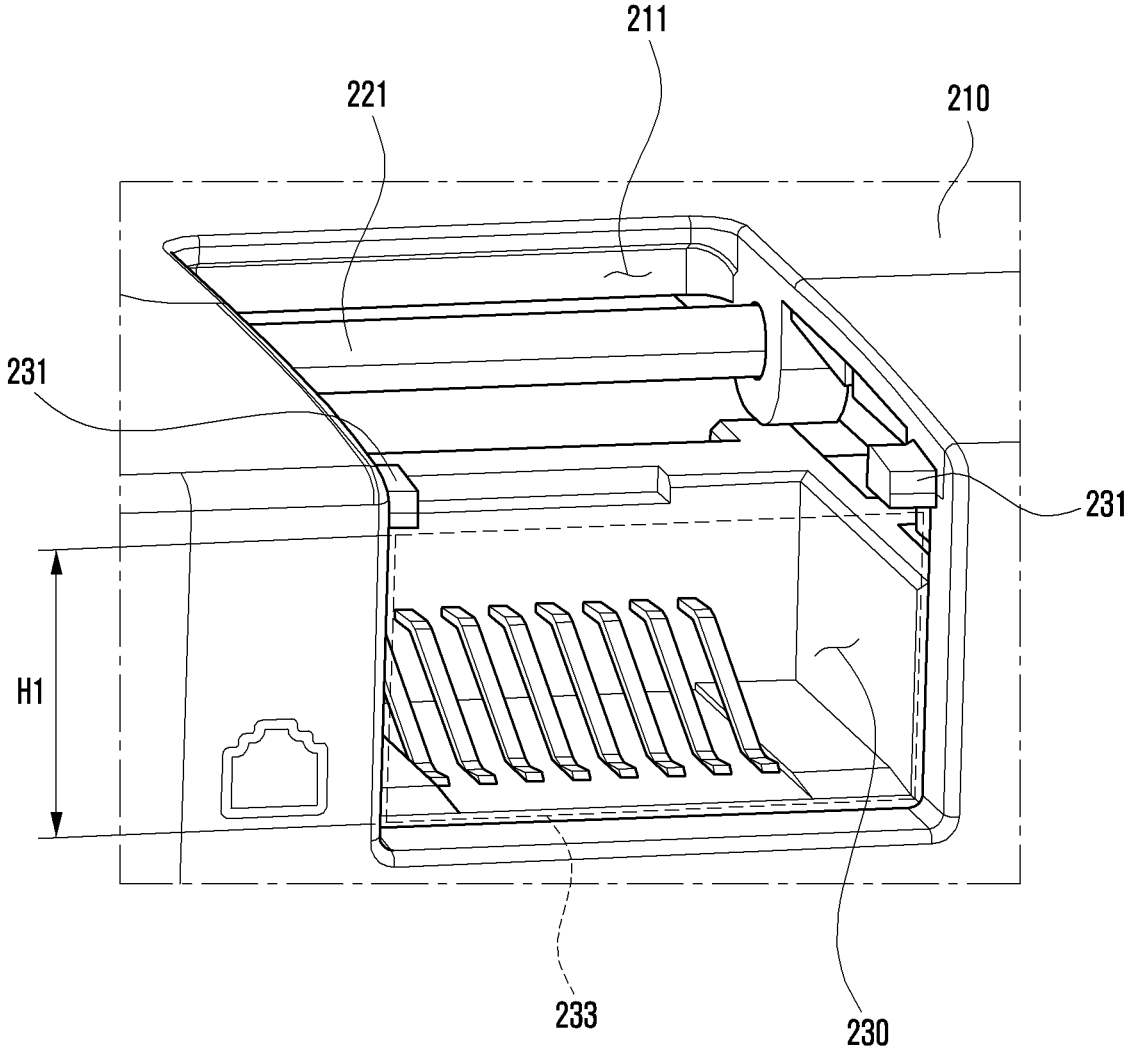
FIG. 4 is a view of the input/output connector with removal of the cover according to an embodiment of the disclosure.

FIG. 4 is a view of the input/output connector 200' whose cover (e.g., cover 220 in FIG. 2) is removed according to an embodiment of the disclosure.

In one embodiment, an opening 211 may be formed in the housing 210. In one embodiment, the opening 211 may be formed such that at least a portion of the input/output connector 200' is exposed. The opening 211 may be formed larger than the insertion hole 230 of the input/output connector 200', and the insertion hole 230 may be formed in part by the opening 211 covered with the cover 220.

In one embodiment, the input/output connector 200' may include a cover 220, a hinge shaft 221, an elastic body 223, a rib 231, and/or an insertion hole 230.

In one embodiment, the cover 220 may be formed to at least partially cover the opening 211 of the housing 210. The cover 220 may partially cover the opening 211 of the housing 210 and may form the external shape of the electronic device 200 together with the housing 210. The cover 220 may form a continuous surface together with the housing 210 to provide a smooth appearance.

In one embodiment, the cover 220 is hinged to the housing 210 so as to be rotated within a preset range. The hinge shaft 221 may be coupled to the housing 210 to provide the center of rotation for the cover 220. The hinge shaft 221 may be formed in the shape of a rod or may be formed in the shape of protrusions projecting in opposite directions from the same axis.

Figure 5:
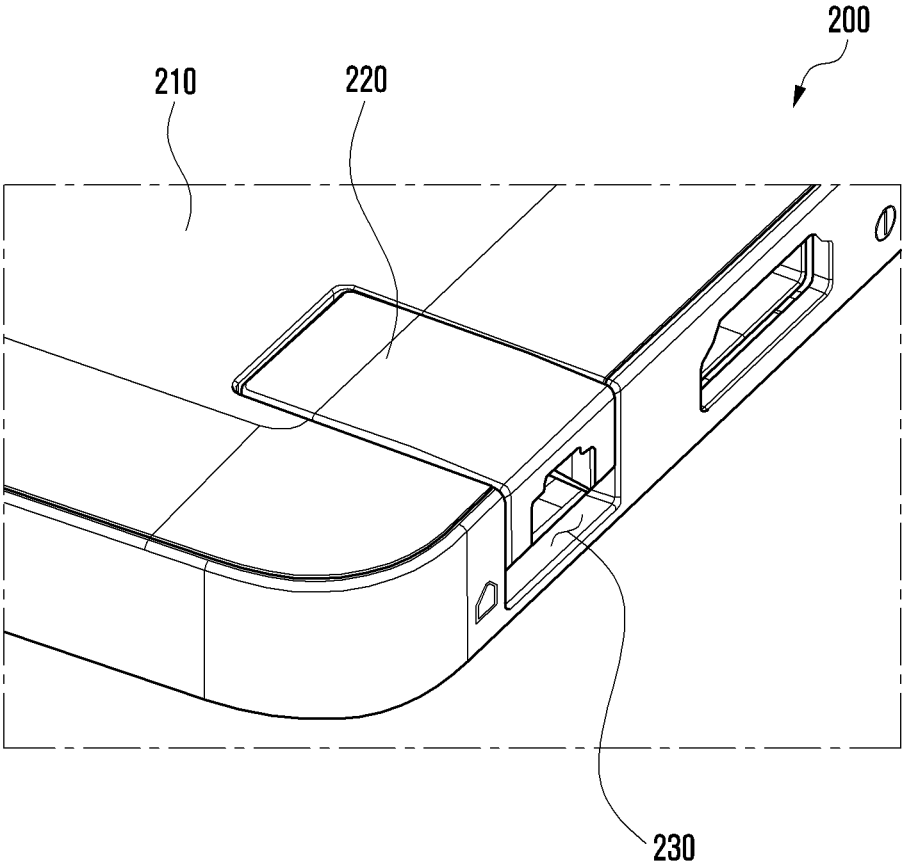
FIG. 5 is an enlarged view of the input/output connector in a first state according to an embodiment of the disclosure.

In one embodiment, the elastic body 223 may provide an elastic force enabling the cover 220 to rotate and return to a specific position. For example, the elastic body 223 may provide an elastic force so that the cover 220 can return to a position forming a continuous surface with the housing 210 as shown in FIG. 5.

In one embodiment, the elastic body 223 may be at least one of a leaf spring, a coil spring, a torsion spring, or a steel wire spring, and may have various configurations capable of providing an elastic force enabling the cover to return to a specific position.

In one embodiment, the insertion hole 230 is a site where the cable terminal 300 is inserted for connection with an external device, and may be formed by the housing 210 and the cover 220. The size of the insertion hole 230 may be changed according to the rotation of the cover 220. The insertion hole 230 may include a first region 233 having a first height H1 and a second region 235 having a second height H2 (in FIG. 6).

In one embodiment, the rib 231 may be formed to protrude in the direction transverse to the insertion hole 230. A plurality of ribs 231 may be formed. For example, as shown in FIG. 4, the ribs 231 may be formed to protrude on the same axis while facing each other. In one embodiment, the rib 231 may serve as a criterion for distinguishing the first region 233 from the second region 235, and may prevent incorrect insertion of the cable terminal 300 (e.g., insertion in reverse direction).

Figure 6:
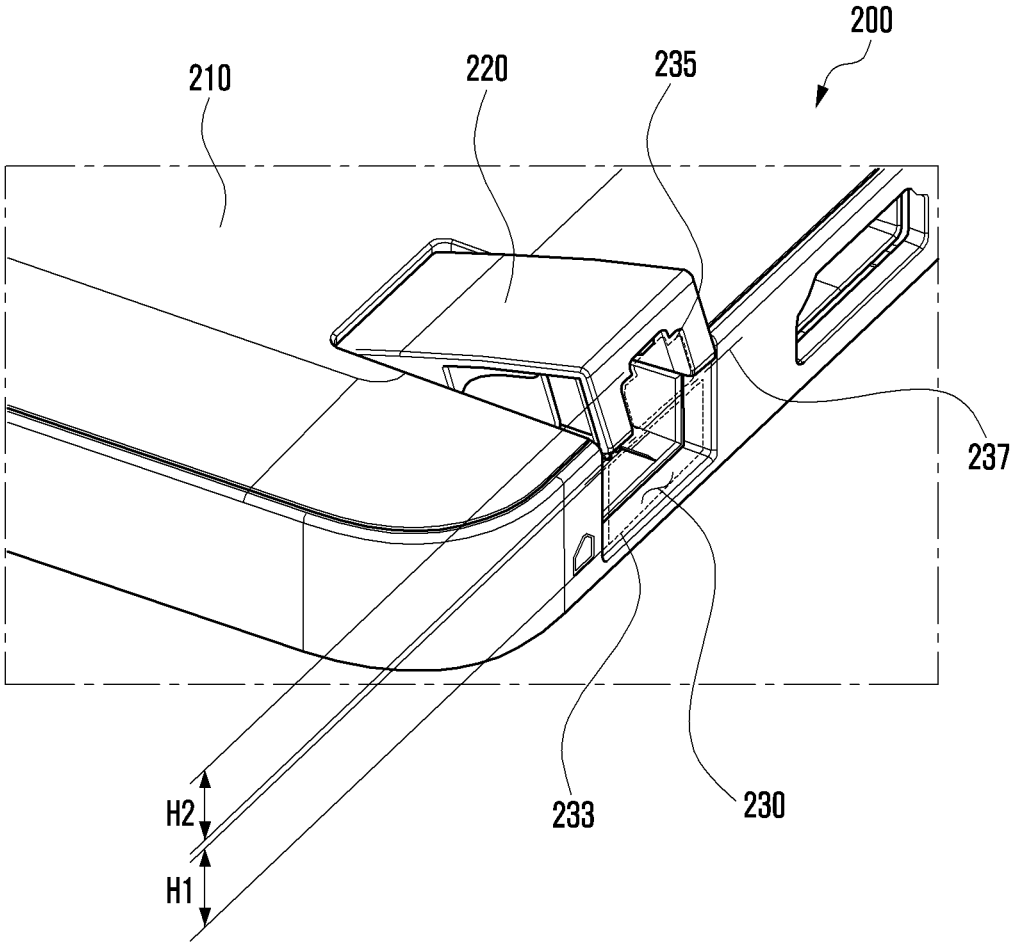
FIG. 6 is an enlarged view of the input/output connector in a second state according to an embodiment of the disclosure.

FIG. 5 is an enlarged view of the input/output connector 200' (in FIG. 2) in a first state according to an embodiment of the disclosure, and FIG. 6 is an enlarged view of the input/output connector 200' in a second state according to an embodiment of the disclosure.

In one embodiment, with reference to FIG. 5, the cover 220 may partially cover the opening 211 of the housing 210 and may form an external appearance of the electronic device 200 together with the housing 210. The cover 220 may form a continuous surface together with the housing 210 to provide a smooth appearance (e.g., the cover may be fully or substantially flush with the housing). This may be referred to as a first state. In one embodiment, the elastic body 223 (in FIG. 4) may apply an elastic force to the cover 220 so that the cover 220 remains disposed in the first state. In the first state, a portion of the insertion hole 230 may be exposed, but the size of the exposed portion of the insertion hole 230 may be smaller than the cross-sectional area (e.g., first region 233 in FIG. 4) of the cable body 301 (in FIG. 10).

In one embodiment, FIG. 6 illustrates a state in which the size of the insertion hole 230 is expanded through the rotation of the cover 220. When the cover 220 is rotated around the hinge shaft 221 (in FIG. 4), the insertion hole 230 may be expanded, so that the cable terminal 300 (in FIG. 10) provided for connection with an external device may be inserted. This configuration may be referred to as a second state. The transition from the first state to the second state can be caused by a user's application of force during insertion of the cable terminal 300.

In one embodiment, the insertion hole 230 may include a first region 233 and a second region 235. The first region 233 and the second region 235 of the insertion hole 230 may be demarcated by an imaginary line 237 extending from the rib 231. The first region 233 may be located on one side of the imaginary line 237 (e.g., lower portion in FIG. 6), and the second region 235 may be located on the other side of the imaginary line 237 (e.g., upper portion in FIG. 6). The first region 233 may be formed to have a first height H1, and may correspond to the cross-sectional area of the cable body 301 (in FIG. 10). The second region 235 may be formed to have a second height H2, and may correspond to the cross-sectional area of the cable clip 303 (in FIG. 10) for maintaining the insertion state of the cable. More specifically, the first region 233 may be formed to have a first length, and the second region 235 may be formed to have a second length inclusive of the thickness of the rib 231.

Figure 7:
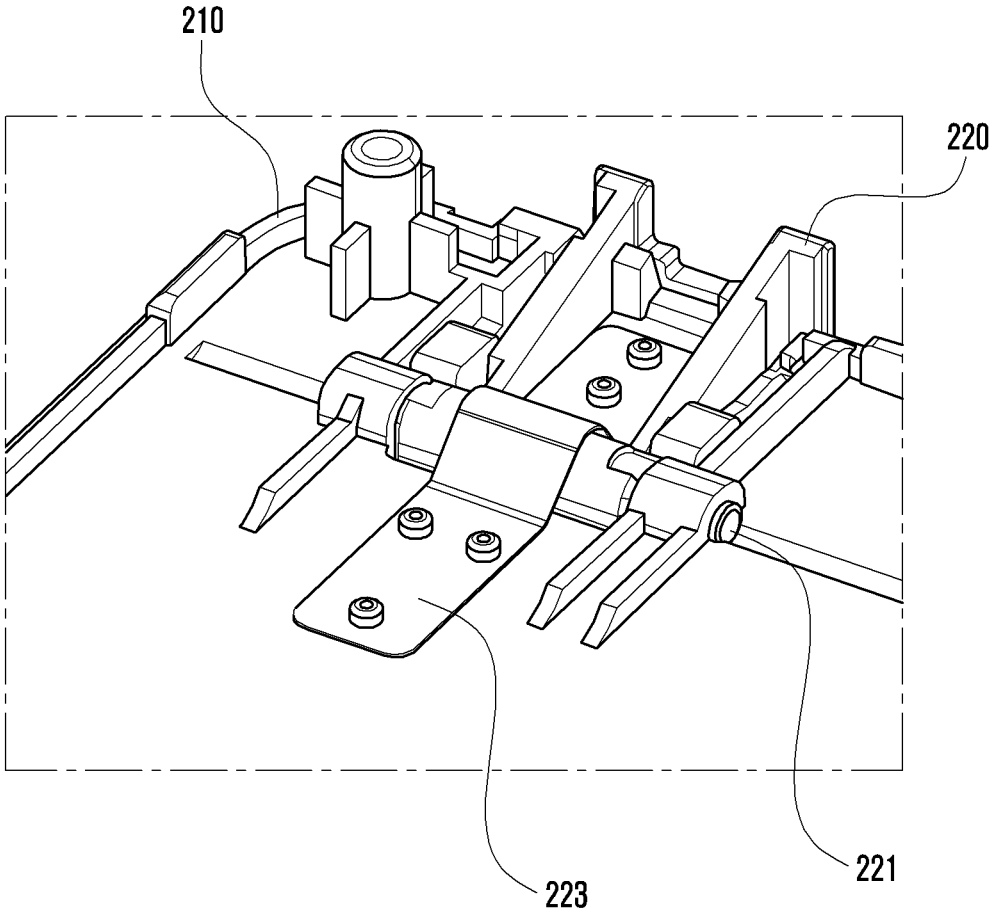
FIGS. 7 and 8 are views of the electronic device whose housing is removed in part according to an embodiment of the disclosure.
Figure 8:
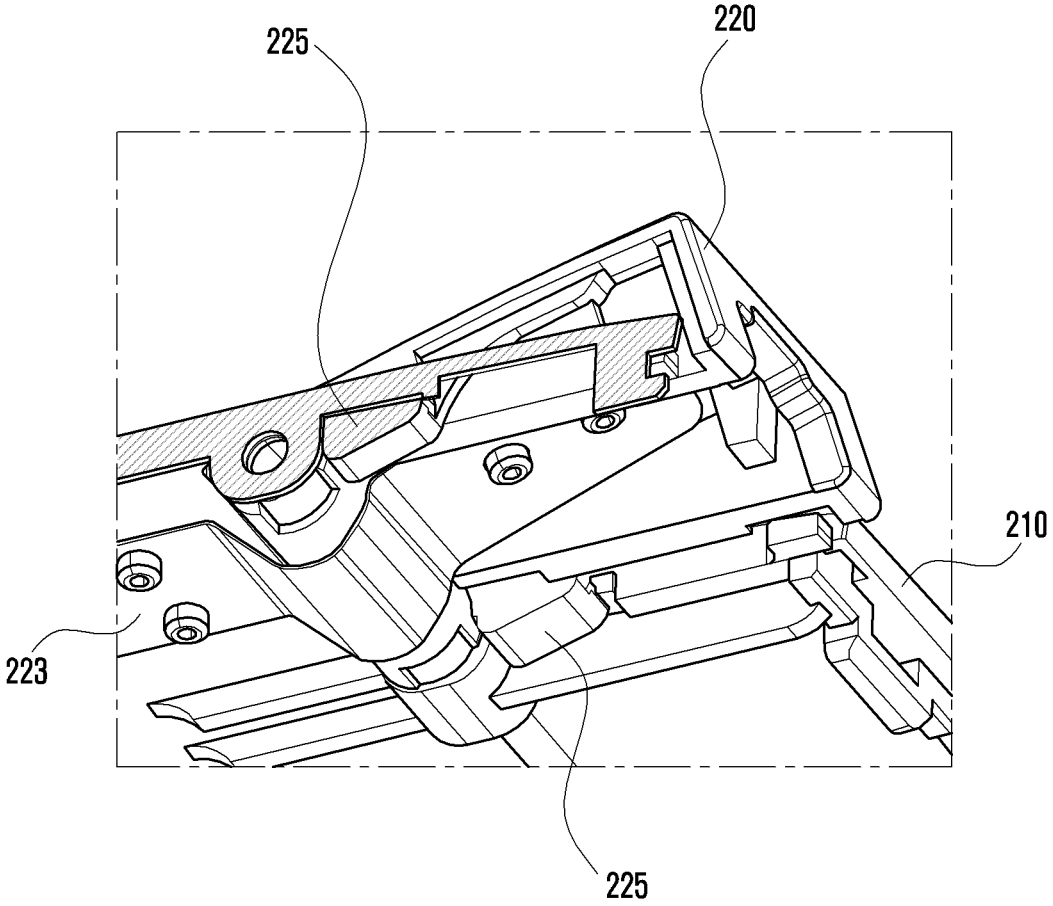

FIGS. 7 and 8 are views of the electronic device 200 when the housing 210 is removed in part, according to an embodiment of the disclosure.

In one embodiment, the cover 220 may be disposed in the first state in FIG. 7, and the cover 220 may be disposed in the second state in FIG. 8.

In one embodiment, with reference to FIG. 7, the elastic body 223 may be formed to at least partially surround the hinge shaft 221, and may be connected to the housing 210 and the cover 220. The elastic body 223 may apply an elastic force to the cover 220 so that the cover 220 remains disposed in the first state to provide a smooth external appearance together with the housing 210.

With reference to FIG. 8, the cover 220 may be rotated by a certain range to protrude from the surface of the housing 210. In one embodiment, the input/output connector 200' may include a stopper 225 to limit the rotation range of the cover 220. The stopper 225 may be formed on either the housing 210 or the cover 220. The stopper 225 may allow the cover 220 to rotate so that the insertion hole 230 is expanded to an extent sufficient to allow insertion of the cable terminal 300, but may prevent further rotation. The rotation range of the cover 220 is limited according to the size of the cable terminal 300. This may prevent the cable terminal 300 from being inserted in a wrong direction or prevent insertion of an incorrect or incompatible type cable terminal.

Figure 9:
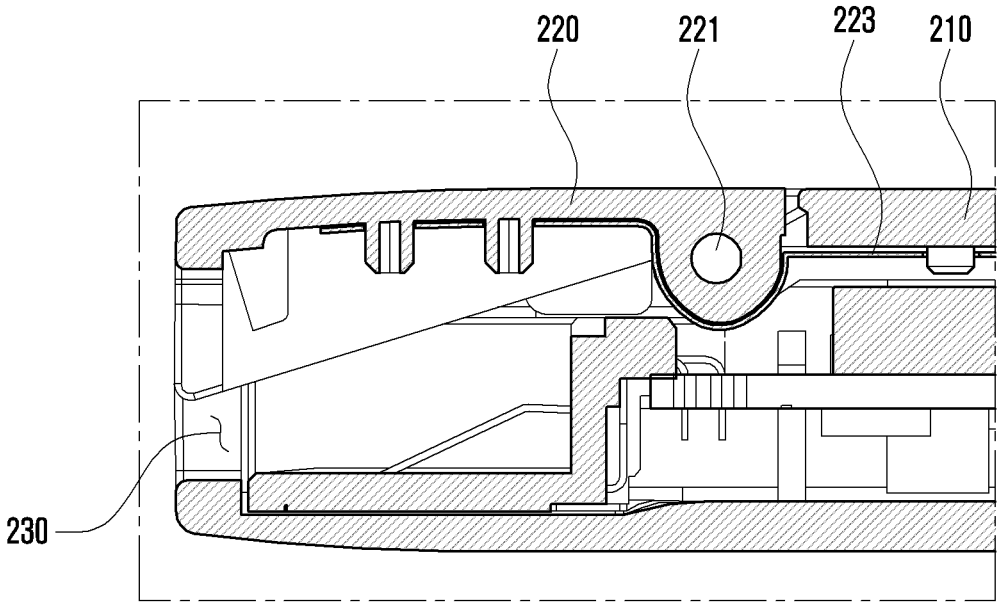
FIG. 9 is a view of the electronic device taken along the line A-A of FIG. 2.
Figure 10:
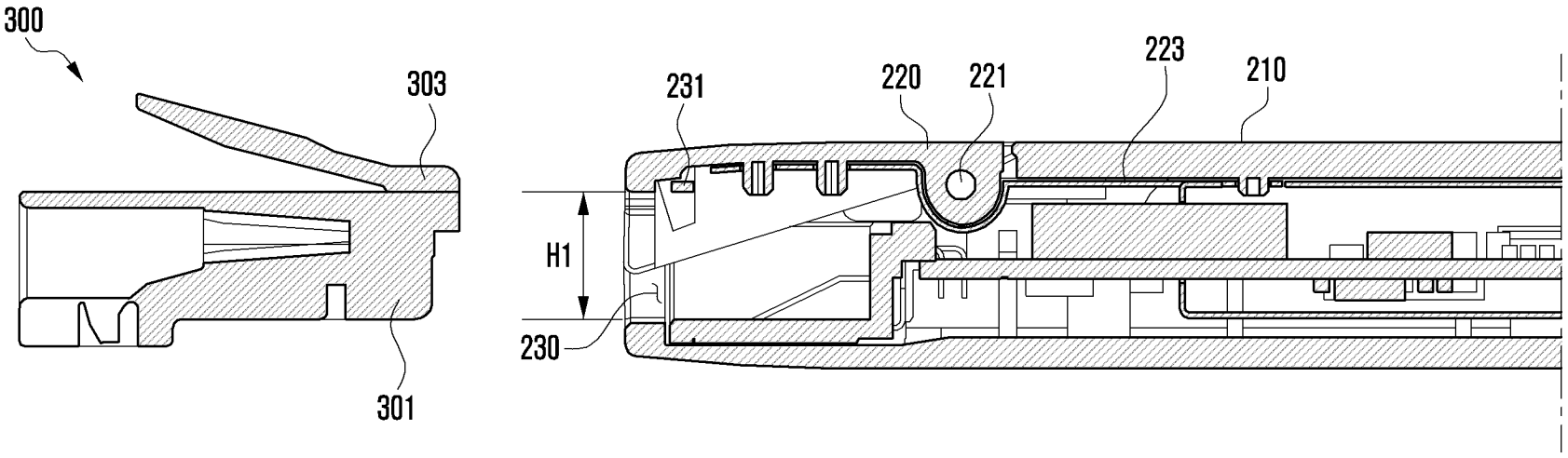
FIGS. 10 and 11 are views illustrating a process in which a cable terminal is inserted into the input/output connector according to an embodiment of the disclosure.
Figure 11:
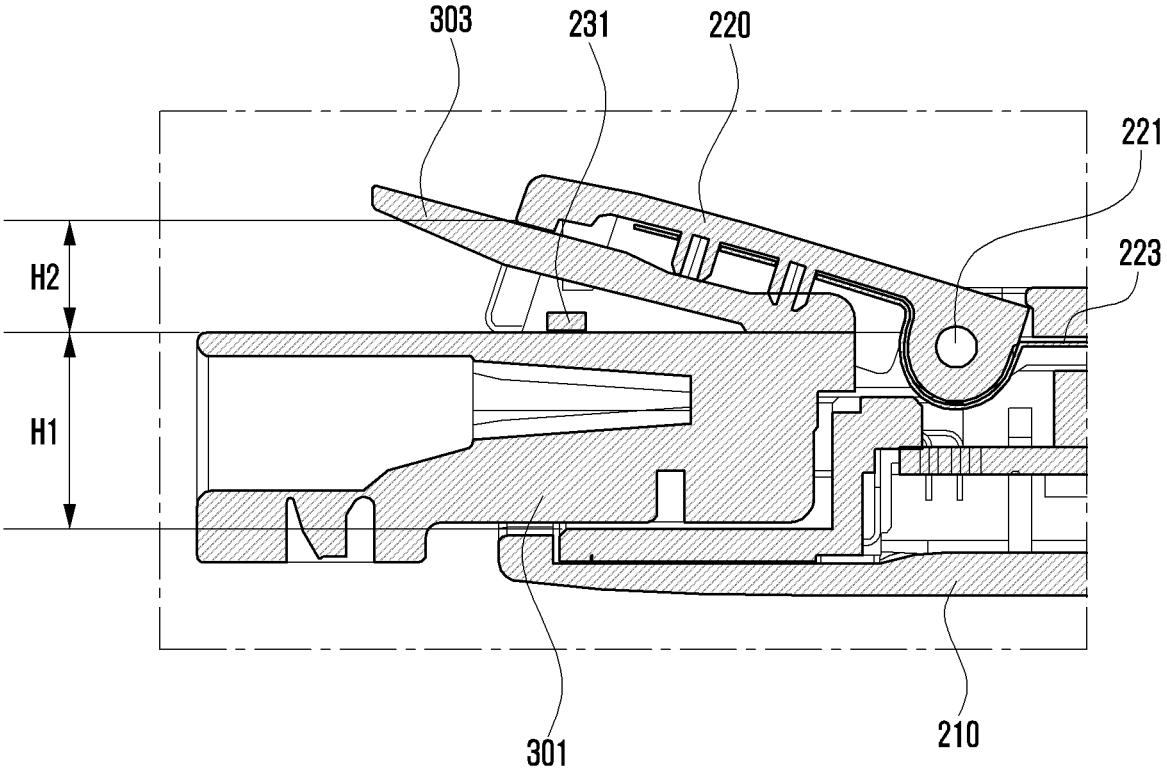

FIG. 9 is a view of the input/output connector 200' taken along the line A-A of FIG. 2. FIGS. 10 and 11 are views illustrating a process in which a cable is inserted in a forward direction into the input/output connector 200' of FIG. 9.

In one embodiment, with reference to FIG. 9, the input/output connector 200' may include a cover 220, a hinge shaft 221, an elastic body 223, a rib 231, and/or an insertion hole 230. In one embodiment, the cover 220 may be connected to the housing 210 via a rotatable hinge, and thus be rotatable within a preset range around the hinge shaft 221. In one embodiment, the elastic body 223 may be formed surrounding at least a portion of the hinge shaft 221, and may be connected to the housing 210 and the cover 220. The elastic body 223 may apply an elastic force to the cover 220 so that the cover 220 remains disposed in the first state where the cover 220 is positioned to form a smooth surface continuous (e.g., flush) with the surface of the housing 210.

In one embodiment, with reference to FIG. 10, the cable may be a LAN cable (e.g., RJ45), and the input/output connector 200' may be a connector for inserting a LAN cable. The cable terminal 300 may include a cable body 301 for forming an electrical connection, and a cable clip 303 to maintain connection of the cable terminal 300 to the input/output connector 200'. The height of the cable body 301 may correspond to the first height H1 of the first region 233, and the height of the cable clip 303 may correspond to the second height H2 of the second region 235. In one embodiment, the rib 231 may divide the insertion hole into a first region 233 having a first height H1 and a second region 235 having a second height H2.

FIG. 11 illustrates a state where the cover 220 is rotated to the second state and the cable terminal 300 is inserted in the forward direction. Here, insertion of the cable terminal 300 in the forward direction may indicate a state where the cable terminal 300 is inserted into the insertion hole 230 so that the cable body 301 corresponds to the first region 233, and the cable clip 303 corresponds to the second region 235.

In one embodiment, as the rib 231 divides the insertion hole 230 so that the first region 233 has a first height H1, the cable body 301 may be inserted into the first region 233. In the case of the cable clip 303 having a second height H2, as the second region 235 is formed to have a second height H2 inclusive of the thickness of the rib 231, the cable clip 303 may interfere with the rib 231 in the process of insertion. However, in one embodiment, as the ribs 231 are formed to face each other but are not connected, the cable clip 303 may be inserted into the second region 235 without interference with the ribs 231.

Figure 12:
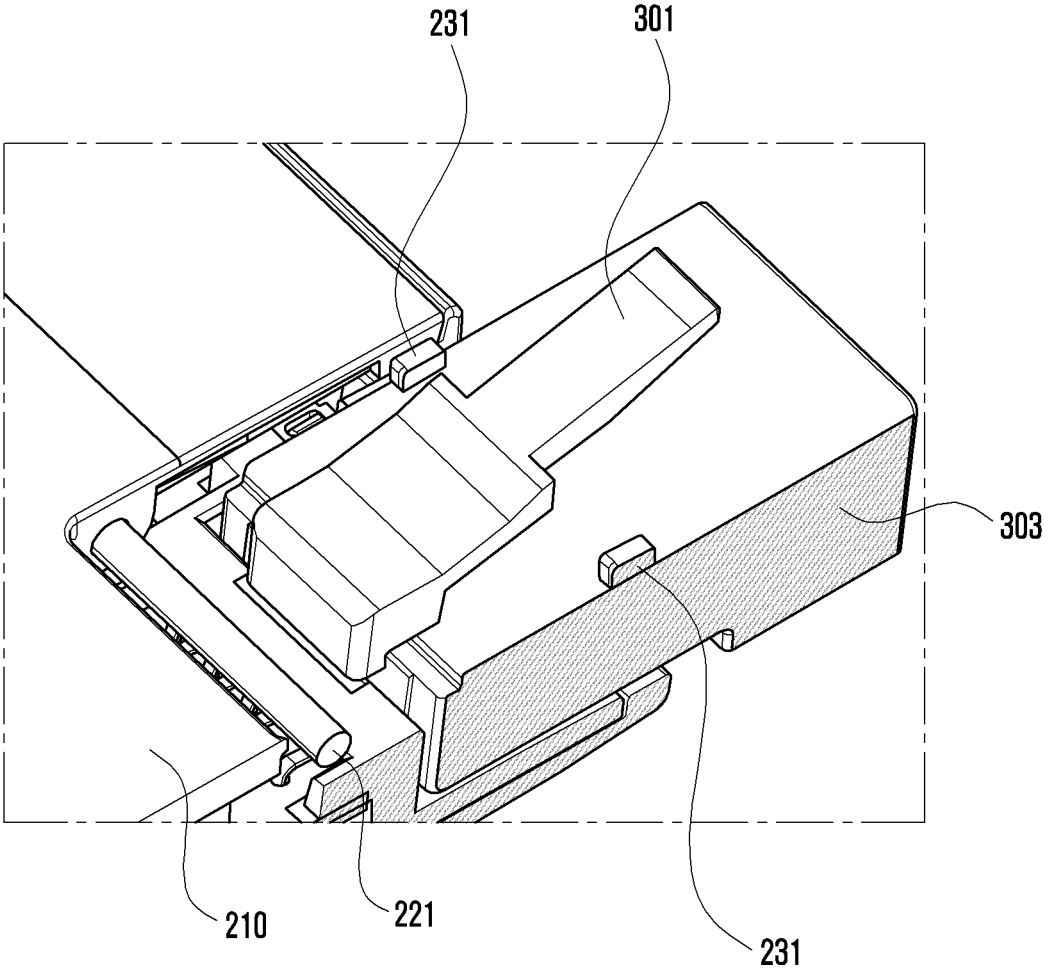
FIG. 12 is a view illustrating a state in which a cable terminal is inserted into the input/output connector with removal of the cover according to an embodiment of the disclosure.

FIG. 12 is a view illustrating a state where the cable terminal 300 is inserted in the forward direction into the input/output connector 200' with removal of the cover according to an embodiment of the disclosure. In one embodiment, as the rib 231 divides the insertion hole 230 so that the first region 233 has a first height H1, the cable body 301 may be inserted into the first region 233. In one embodiment, as the ribs 231 are formed to face each other but are not connected, the cable clip 303 may be inserted into the second region 235 without interference with the ribs 231.

Figure 13:
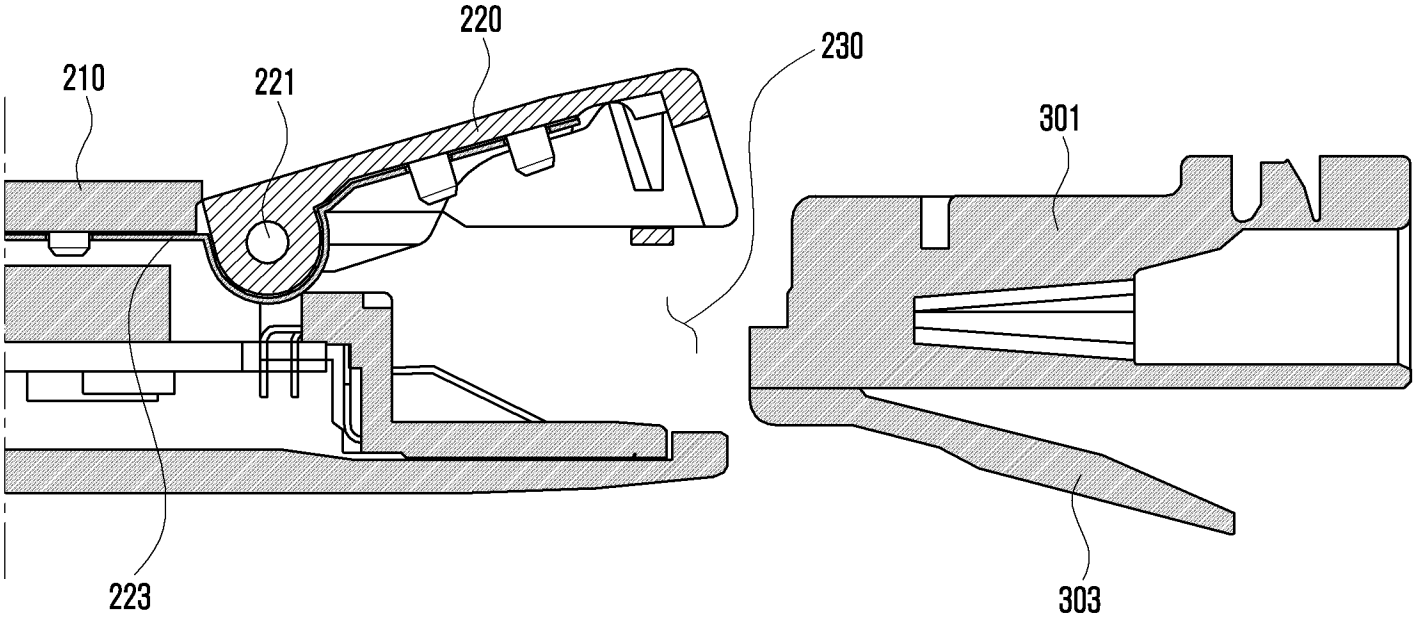
FIGS. 13 and 14 are views illustrating a process of blocking an attempt to incorrectly insert a cable terminal into the input/output connector according to an embodiment of the disclosure.
Figure 14:
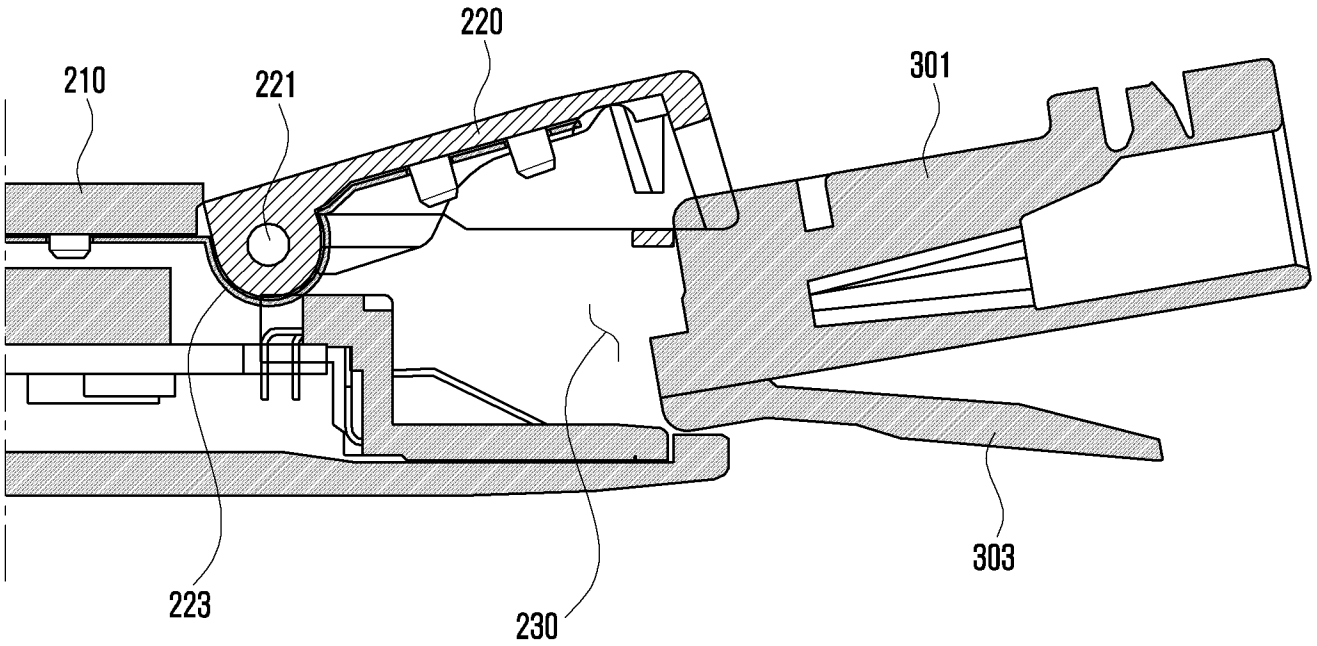

FIGS. 13 and 14 are views illustrating obstruction of an incorrect insert (e.g., insertion in reverse direction) of the cable terminal 300 into the input/output connector 200', according to an embodiment of the disclosure.

In the description, incorrect insertion of the cable terminal 300 or insertion in the reverse direction, may indicate a state in which the cable terminal 300 is inserted into the insertion hole 230 such that the cable clip 303 corresponds to the first region 233 of the insertion hole 230, and the cable body 301 corresponds to the second region 235.

With reference to FIGS. 13 and 14, when an attempt is made to insert the cable terminal 300 in the reverse direction, the cable body 301 cannot pass through the space between the ribs 231 due to the characteristics of the shape of the cable body 301. As a result, insertion of the cable terminal 300 may be blocked as a result of the interference between the ribs 231 and the cable body 301.

Figure 15:
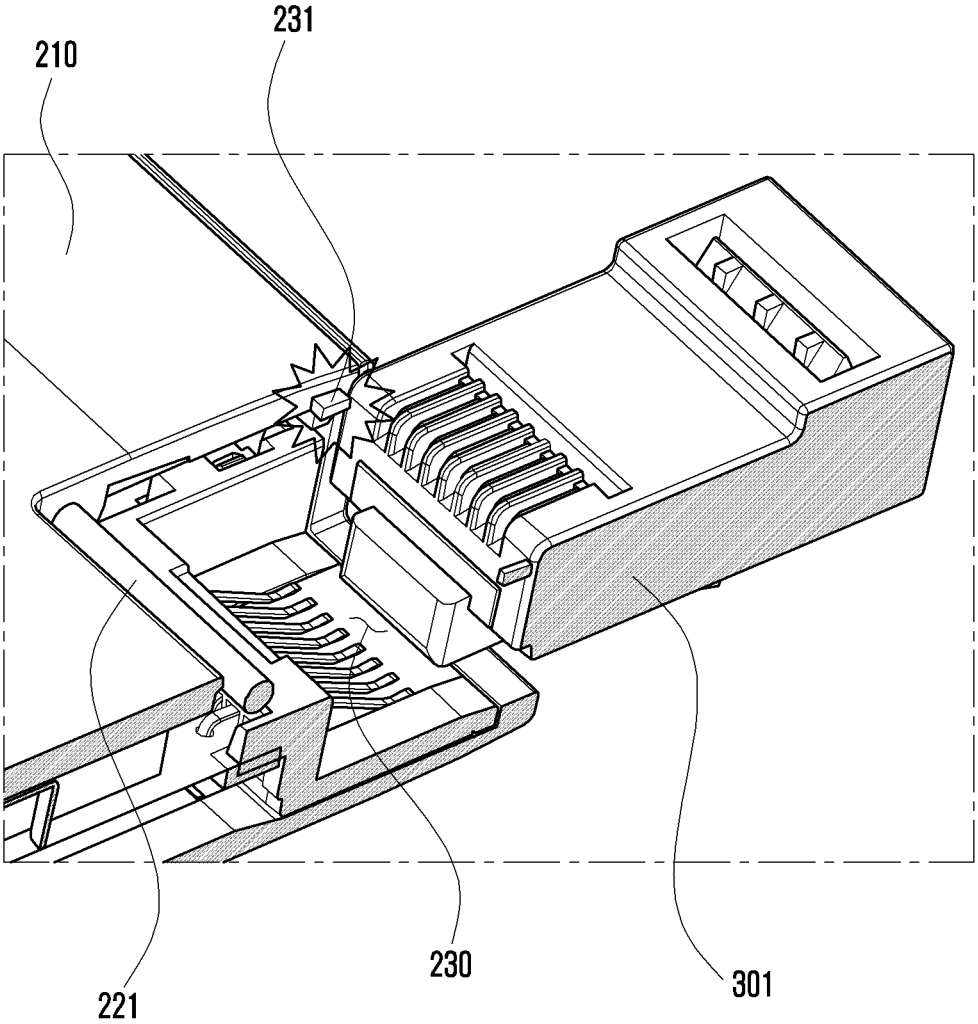
FIG. 15 is a view illustrating blocking an attempt to incorrectly insert a cable terminal into the input/output connector with removal of the cover according to an embodiment of the disclosure.

FIG. 15 is a view illustrating obstruction of an incorrect insertion of the cable terminal 300 into the input/output connector 200' with removal of the cover 220 according to an embodiment of the disclosure.

When an attempt is made to insert the cable terminal 300 in the reverse direction, the cable body 301 cannot pass through the space defined between the ribs 231 due to the characteristics of the shape of the cable body 301 (even though the overall height of the insertion hole 230 (H1+H2) and the height of the cable terminal 300 may correspond), resulting in blockage of the attempted insertion of the cable terminal 300 in the reverse direction. Hence, it is possible to prevent the damage to the input/output connector 200' caused by incorrect insertion of the cable terminal 300 (e.g., damage to the insertion hole 230 or damage to the connector pin).

According to an embodiment of the disclosure, an input/output connector (e.g., input/output connector 200' in FIG. 2) may include: a housing (e.g., housing 210 in FIG. 2) that forms an external appearance of an electronic device (e.g., electronic device 200 in FIG. 2) and includes an opening (e.g., opening 211 in FIG. 4) formed at a specific portion; a cover (e.g., cover 220 in FIG. 5) that is formed to cover at least a portion of the opening, is hinged to the housing, and forms the external appearance of the electronic device together with the housing; an elastic body (e.g., elastic body 223 in FIG. 7) connected to the housing and the cover; and an insertion hole (e.g., insertion hole 230 in FIG. 10) that is formed by the housing and the cover, into which a cable terminal (e.g., cable terminal 300 in FIG. 10) for connection with an external device is to be inserted, and whose size is changed according to the rotation of the cover.

The input/output connector (e.g., input/output connector 200' in FIG. 2) may further include a hinge shaft (e.g., hinge shaft 221 in FIG. 10) that provides a rotation center of the cover (e.g., cover 220 in FIG. 5). The elastic body (e.g., elastic body 223 in FIG. 7) may be formed to surround at least a portion of the hinge shaft, and may apply an elastic force to the cover.

The cover (e.g., cover 220 in FIG. 5) may include a first state (e.g., FIG. 5) where the cover forms a smooth appearance of the electronic device together with the housing (e.g., housing 210 in FIG. 5), and a second state (e.g., FIG. 6) where the cover is rotated to allow the cable terminal (e.g., cable terminal 300 in FIG. 10) to be inserted into the insertion hole (e.g., insertion hole 230 in FIG. 6). The elastic body (e.g., elastic body 223 in FIG. 7) may apply an elastic force so that the first state is maintained.

A stopper (e.g., stopper 225 in FIG. 8) for determining a rotation range of the cover transitioning from the first state (e.g., FIG. 5) to the second state (e.g., FIG. 6) may be formed on the cover (e.g., cover 220 in FIG. 5 or 6) or the housing (e.g., housing 210 in FIG. 5 or 6).

The input/output connector may further include a rib (e.g., rib 231 in FIG. 10) protruding in a direction transverse to the insertion hole (e.g., insertion hole 230 in FIG. 10) in the housing (e.g., housing 210 in FIG. 10) when viewed toward the insertion hole.

The input/output connector may include plural ribs aligned with respect to a direction transverse to the insertion hole (e.g., insertion hole 230 in FIG. 10).

When viewed toward the insertion hole (e.g., insertion hole 230 in FIG. 6) in the second state (e.g., FIG. 6), the insertion hole may include a first region (e.g., first region 233 in FIG. 6) located on one side of an imaginary line (e.g., line 237 in FIG. 6) extending in a direction where the rib (e.g., rib 231 in FIG. 11) protrudes and having a first height (e.g., first height H1 in FIG. 6), and a second region (e.g., second region 235 in FIG. 6) located on the other side of the imaginary line and having a second height (e.g., second height H2 in FIG. 6).

The first region (e.g., first region 233 in FIG. 6) of the insertion hole (e.g., insertion hole 230 in FIG. 6) may be greater than the second region (e.g., second region 235 in FIG. 6).

The first region (e.g., first region 233 in FIG. 6) may correspond to the cross-sectional area of the cable terminal (e.g., cable terminal 300 in FIG. 10), and the second region (e.g., second region 235 in FIG. 6) may correspond to the cross-sectional area of a clip (e.g., cable clip 303 in FIG. 10) for maintaining the insertion state of the cable (e.g., connection cable 240 in FIG. 2).

When the cover is in the first state (e.g., FIG. 5), the insertion hole (e.g., insertion hole 230 in FIG. 5) may become less than or equal to the size of the first region (e.g., first region 233 in FIG. 6).

According to an embodiment of the disclosure, an electronic device (e.g., electronic device 200 in FIG. 2) may include: a housing (e.g., housing 210 in FIG. 2) that forms an external appearance of the electronic device, has an internal space, and includes an opening (e.g., opening 211 in FIG. 4) formed at a specific portion; a connection cable (e.g., connection cable 240 in FIG. 2) that is housed in the internal space of the housing to be pulled in or out and is used for connection with an external electronic device; and an input/output connector (e.g., input/output connector 200' in FIG.

2) disposed in the opening of the housing. The input/output connector may include: a cover (e.g., cover 220 in FIG. 5) that is formed to cover at least a portion of the opening of the housing, is hinged to the housing, and forms the external appearance of the electronic device together with the housing; an elastic body (e.g., elastic body 223 in FIG. 7) connected to the housing and the cover; and an insertion hole (e.g., insertion hole 230 in FIG. 10) that is formed by the housing and the cover, into which a cable terminal (e.g., cable terminal 300 in FIG. 10) for connection with an external device is to be inserted, and whose size is changed according to the rotation of the cover.

The input/output connector (e.g., input/output connector 200' in FIG. 2) may further include a hinge shaft (e.g., hinge shaft 221 in FIG. 10) that provides a rotation center of the cover (e.g., cover 220 in FIG. 10). The elastic body (e.g., elastic body 223 in FIG. 10) may be formed to surround at least a portion of the hinge shaft, and may apply an elastic force to the cover.

The cover (e.g., cover 220 in FIG. 5 or 6) may include a first state (e.g., FIG. 5) where the cover forms a smooth appearance of the electronic device together with the housing (e.g., housing 210 in FIG. 5 or 6), and a second state (e.g., FIG. 6) where the cover is rotated to allow the cable terminal (e.g., cable terminal 300 in FIG. 10) to be inserted into the insertion hole (e.g., insertion hole 230 in FIG. 6). The elastic body (e.g., elastic body 223 in FIG. 7) may apply an elastic force so that the first state is maintained.

A stopper (e.g., stopper 225 in FIG. 8) for determining a rotation range of the cover transitioning from the first state (e.g., FIG. 5) to the second state (e.g., FIG. 6) may be formed on the cover (e.g., cover 220 in FIG. 8) or the housing (e.g., housing 210 in FIG. 8).

The input/output connector may further include a rib (e.g., rib 231 in FIG. 10) protruding in a direction transverse to the insertion hole (e.g., insertion hole 230 in FIG. 10) in the housing (e.g., housing 210 in FIG. 10) when viewed toward the insertion hole.

The input/output connector may include plural ribs (e.g., ribs 231 in FIG. 10) aligned with respect to a direction transverse to the insertion hole (e.g., insertion hole 230 in FIG. 10).

When viewed toward the insertion hole (e.g., insertion hole 230 in FIG. 6) in the second state (e.g., FIG. 6), the insertion hole may include a first region (e.g., first region 233 in FIG. 6) located on one side of an imaginary line (e.g., line 237 in FIG. 6) extending in a direction where the rib (e.g., rib 231 in FIG. 11) protrudes and having a first height (e.g., first height H1 in FIG. 6), and a second region (e.g., second region 235 in FIG. 6) located on the other side of the imaginary line and having a second height (e.g., second height H2 in FIG. 6).

The first region (e.g., first region 233 in FIG. 6) of the insertion hole (e.g., insertion hole 230 in FIG. 6) may be greater than the second region (e.g., second region 235 in FIG. 6).

The first region (e.g., first region 233 in FIG. 6) may correspond to the cross-sectional area of the cable terminal (e.g., cable terminal 300 in FIG. 10), and the second region (e.g., second region 235 in FIG. 6) may correspond to the cross-sectional area of a clip (e.g., cable clip 303 in FIG. 10) for maintaining the insertion state of the cable (e.g., connection cable 240 in FIG. 2).

When the cover (e.g., cover 220 in FIG. 5) is in the first state (e.g., FIG. 5), the insertion hole (e.g., insertion hole 230 in FIG. 5) may be less than or equal to the size of the first region (e.g., first region 233 in FIG. 6).

While the disclosure has been particularly shown and described with reference to embodiments thereof, it will be understood by those skilled in the art that various changes in form and details may be made therein without departing from the scope of the subject matter as defined by the appended claims and their equivalents.

What is claimed is:

1. An electronic device comprising:

a housing; and a connector connected with the housing, the connector comprising:

a cover rotatably connected to the housing by a shaft, and forming an external appearance of the electronic device together with the housing, wherein an insertion hole for inserting an external connector is formed by the housing and the cover, and wherein a size of the insertion hole is changeable according to a rotation of the cover; and an elastic body in a form of a plate positioned across the shaft and connected to the housing and the cover, the elastic body providing an elastic force enabling the cover to return to a return position when the external connector is separated from the insertion hole.

2. The electronic device of claim 1, wherein the elastic body includes a first portion coupled to the housing, a second portion coupled to the cover, and a third portion surrounding a portion of the shaft and connecting the first portion and the second portion.

3. The electronic device of claim 2, wherein the third portion is a curved shape surrounding the portion of the shaft compared with the first portion and the second portion.

4. The electronic device of claim 1, wherein, when the external connector is inserted into the insertion hole, the cover is rotated by the external connector with supported by the elastic force of the elastic body.

5. The electronic device of claim 1, further comprising at least one rib positioned corresponding to the insertion hole in order to interfere with misaligned insertion of the external connector.

6. The electronic device of claim 5, wherein the at least one rib is protruded in a direction transverse to the insertion hole when viewed from a position facing the insertion hole.

7. The electronic device of claim 6, wherein the at least one rib is formed in the housing.

8. The electronic device of claim 6, wherein the at least one rib includes a first rib and a second rib aligned to a direction transverse to the insertion hole.

9. The electronic device of claim 8, wherein, when the external connector is inserted into the insertion hole and therefore the cover is rotated, when viewed facing the insertion hole, the insertion hole includes a first region located on one side of an imaginary line extending in an alignment direction of the first rib and the second rib and a second region located on the other side of the imaginary line, and wherein, when viewed facing the insertion hole, the first region has a first height in a direction orthogonal to the alignment direction and the second region has a second height different with the first height.

10. The electronic device of claim 9, wherein the first region is larger than the second region.

11. The electronic device of claim 9, wherein the first region corresponds to a first cross-sectional area of the external connector, and the second region corresponds to a clip of the external connector for maintaining insertion of the external connector.

12. The electronic device of claim 9, wherein, when viewed facing the insertion hole, a size of the insertion hole is less than or equal to the size of the first region in the return position of the cover.

13. The electronic device of claim 1, wherein the cover is flush with the housing to form a smooth external appearance of the electronic in the return position.

14. The electronic device of claim 1, further comprising a stopper that defines at least in part a rotational range of the cover when the external connector is inserted into the insertion hole and therefore the cover is rotated, the stopper formed on the cover or on the housing.

15. The electronic device of claim 14, wherein the shaft is secured in part by a bracket extending adjacent towards a front external face of the cover, and wherein the stopper defines at least in part the rotational range of the cover by striking the bracket when a maximum of the rotational range is reached.

16. The electronic device of claim 1, wherein the connector is a connector for LAN(local area network).

17. An electronic device comprising:

a housing; and a connector connected with the housing, the connector comprising:

a cover rotatably connected to the housing by a shaft, and forming an external appearance of the electronic device together with the housing, wherein an insertion hole for inserting an external connector is formed by the housing and the cover, and wherein a size of the insertion hole is changeable according to a rotation of the cover; and an elastic body in a form of a plate positioned across the shaft and connected to the housing and the cover, the elastic body providing an elastic force enabling the cover to return to a return position when the external connector is separated from the insertion hole, wherein the elastic body includes a first portion coupled to the housing, a second portion coupled to the cover, and a third portion surrounding a portion of the shaft and connecting the first portion and the second portion.

18. The electronic device of claim 17, wherein, when the external connector is inserted into the insertion hole, the cover is rotated by the external connector with supported by the elastic force of the elastic body.

19. The electronic device of claim 17, further comprising at least one rib positioned corresponding to the insertion hole in order to interfere with misaligned insertion of the external connector.

20. The electronic device of claim 19, wherein the at least one rib is protruded in a direction transverse to the insertion hole when viewed from a position facing the insertion hole.

* * * * *